US009508481B1

(12) United States Patent
Reynolds

(10) Patent No.: US 9,508,481 B1
(45) Date of Patent: Nov. 29, 2016

(54) TRANSFORMER ACCESS APPARATUS

(71) Applicant: Richard L. Reynolds, Ocala, FL (US)

(72) Inventor: Richard L. Reynolds, Ocala, FL (US)

( * ) Notice: Subject to any disclaimer, the term of this patent is extended or adjusted under 35 U.S.C. 154(b) by 0 days.

(21) Appl. No.: 15/080,550

(22) Filed: Mar. 24, 2016

(51) Int. Cl.
*H01F 27/06* (2006.01)

(52) U.S. Cl.
CPC ..... *H01F 27/06* (2013.01)

(58) Field of Classification Search
USPC ..... 174/50, 38
See application file for complete search history.

(56) References Cited

U.S. PATENT DOCUMENTS

RE31,134 E * 1/1983 Lux, Jr. ..... H01F 27/02 174/38

* cited by examiner

*Primary Examiner* — Dhirubhai R Patel
(74) *Attorney, Agent, or Firm* — Massinger Law Office

(57) ABSTRACT

A method and apparatus for providing temporary secure electric cable access to a terminal of a transformer mounted on a pad; the apparatus includes: 1) at least one riser for supporting an end of the transformer a distance above the pad thereby creating a gap between the pad and the transformer, the distance being sufficient to allow axial passage of the cable through the gap; 2) a barrier shaped for abutting engagement with the transformer and sized to cover the gap; 3) a cable access portal disposed through the barrier; the cable access portal being sized to permit axial passage of the cable; and 4) a barrier lock removably mounted to the barrier for removably securing the barrier to the transformer.

20 Claims, 6 Drawing Sheets

TRANSFORMER ACCESS APPARATUS

FIELD OF THE INVENTION

The present invention pertains generally to emergency power restoration of power, and more particularly to an apparatus for facilitating the temporary attachment of an above ground cable to a transformer.

BACKGROUND OF THE INVENTION

Transformers are used to increase or decrease the voltages of alternating current in electric power applications and are typically mounted either above ground on a junction pole, or at ground level on a pad commonly formed of concrete. In pad-mounted transformer applications, an end of an underground cable is routed from the ground up through an opening in the pad for connection to the transformer via a terminal. Because pad-mounted transformers are located at ground level, they present a risk to anyone who may come into contact with them. More specifically, there exists a significant risk of serious injury or death to anyone who comes into contact with the high voltage connections between the underground cable and the transformer. The increase in use of underground power distribution systems has resulted in a corresponding increase in the number of pad-mounted transformers, and thus a corresponding increase in risk. In order to minimize this risk, pad-mounted transformers are typically enclosed in a metal cabinet, also referred to as a transformer "box," to prevent tampering with the dangerous electrical connections inside. Authorized technicians who service the transformers may gain access to the electrical connections and transformer components generally by opening a large access door located at the front of the cabinet and which is otherwise maintained in a closed and locked condition.

When an underground power cable faults resulting in loss of power, in order to restore power as soon as possible, many power companies will connect a temporary emergency cable, also called a "ground strap", above the ground between a transformer and the building needing power (or between two transformers) until the faulted line can be repaired. Surprisingly, many existing transformer boxes do not provide an above ground entry point, called a "mouse hole" or "rat hole", through which a temporary repair cable can be threaded. It is unsafe to run the temporary cable through the cabinet door because such a practice would leave the dangerous electrical connections accessible to the public. Moreover, cutting a hole in the cabinet or cabinet door is not a recommended practice for safety issues and because upon removal of the temporary cable the opening would have to be repaired resulting in additional labor, time and expense. Accordingly, in order to connect the ground strap to the transformer, the current practice is to create a temporary subterranean entry point for the cable by digging a hole next to the transformer, tunneling under the transformer pad, and then up to the pad opening so that the ground strap may then be threaded through the tunnel and into the cabinet. This is a time and labor intensive task, particularly when performed when visibility is low such as at night, in inclement weather such as during extreme heat, cold, rain or snow, and/or when ground conditions are poor such as when the ground is frozen and/or comprised of rock or stone.

Given the considerable number of pad-mounted transformers that do not include a secure entry point for an emergency repair cable, and given further the significant cost in time and labor associated with creating a subterranean cable access point, it is clear that there exists a need in the art for a safe and cost effective alternative means for providing secure temporary cable access.

SUMMARY OF THE INVENTION

Accordingly, it is a primary object of the present invention to provide a method and apparatus for facilitating the attachment of a temporary emergency electric cable or "ground strap" to a pad-mounted transformer for the purpose of achieving rapid emergency power restoration.

It is also a primary object of the present invention to provide a method and apparatus for facilitating the attachment of a temporary emergency electric cable to a pad-mounted transformer that obviates the need for excavating under the pad.

Another primary object of the present invention is to provide a method and apparatus that permits attachment of a temporary above ground emergency electric cable to a pad-mounted transformer while simultaneously preventing public access to the hazardous electrical connections within the transformer cabinet.

It is also a primary object of the subject invention to provide a pad-mounted transformer access apparatus and method that save time and expense associated with the provision of emergency power restoration in comparison to conventional methods.

It is also an object of the subject invention to provide a transformer access apparatus that is comprised of inexpensive materials and components and therefore capable of rapid construction at a relatively low cost.

Still another object of the subject invention is to provide a transformer access apparatus that is simple in design and assembly and therefore capable of rapid in situ installation by utility repair personnel.

Yet another object of the subject invention is to provide a transformer access apparatus that is relatively light in weight and comprised of components suitable for stacking together in a bundle and, therefore, is highly transportable and storable in utility repair vehicles without sacrificing considerable space.

These together with other objects of the invention, along with the various features of novelty which characterize the invention, are pointed out with particularity in the claims annexed to and forming a part of this disclosure, and will become readily apparent to those skilled in the art upon consideration of the drawings and detailed description below.

By way of summary, the above recited objects of the present invention, as well as others, are obtained by the provision of a method and apparatus for: 1) supporting one end of a pad-mounted transformer cabinet a distance above the pad upon which it is mounted, the distance being sufficient to allow passage of an emergency cable between the pad and the cabinet for connection to the transformer, 2) covering with a plurality of barriers all openings created between the pad and the cabinet to prevent public access inside the cabinet; 3) providing in one of said plurality of barriers a cable access portal sized and shaped to receive there through an emergency cable, and 4) preventing removal of the plurality of barriers with a locking mechanism.

According to one aspect of the present invention there is provided an apparatus for providing temporary secure electric cable access to a terminal of a transformer mounted on a pad, the apparatus comprising: 1) at least one riser for supporting an end of the transformer a distance above the pad thereby creating a gap between the pad and the transformer, said distance being sufficient to allow axial passage of the cable through the gap; 2) a barrier shaped for abutting engagement with the transformer and sized to cover the gap; 3) a cable access portal disposed through said barrier; said cable access portal being sized to permit axial passage of the cable; and 4) a barrier lock removably mounted to said barrier for removably securing said barrier to the transformer. In certain embodiments, the at least one riser is fixedly attached to one of the plurality of barriers.

There has thus been outlined, rather broadly, the more important components and features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the included abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
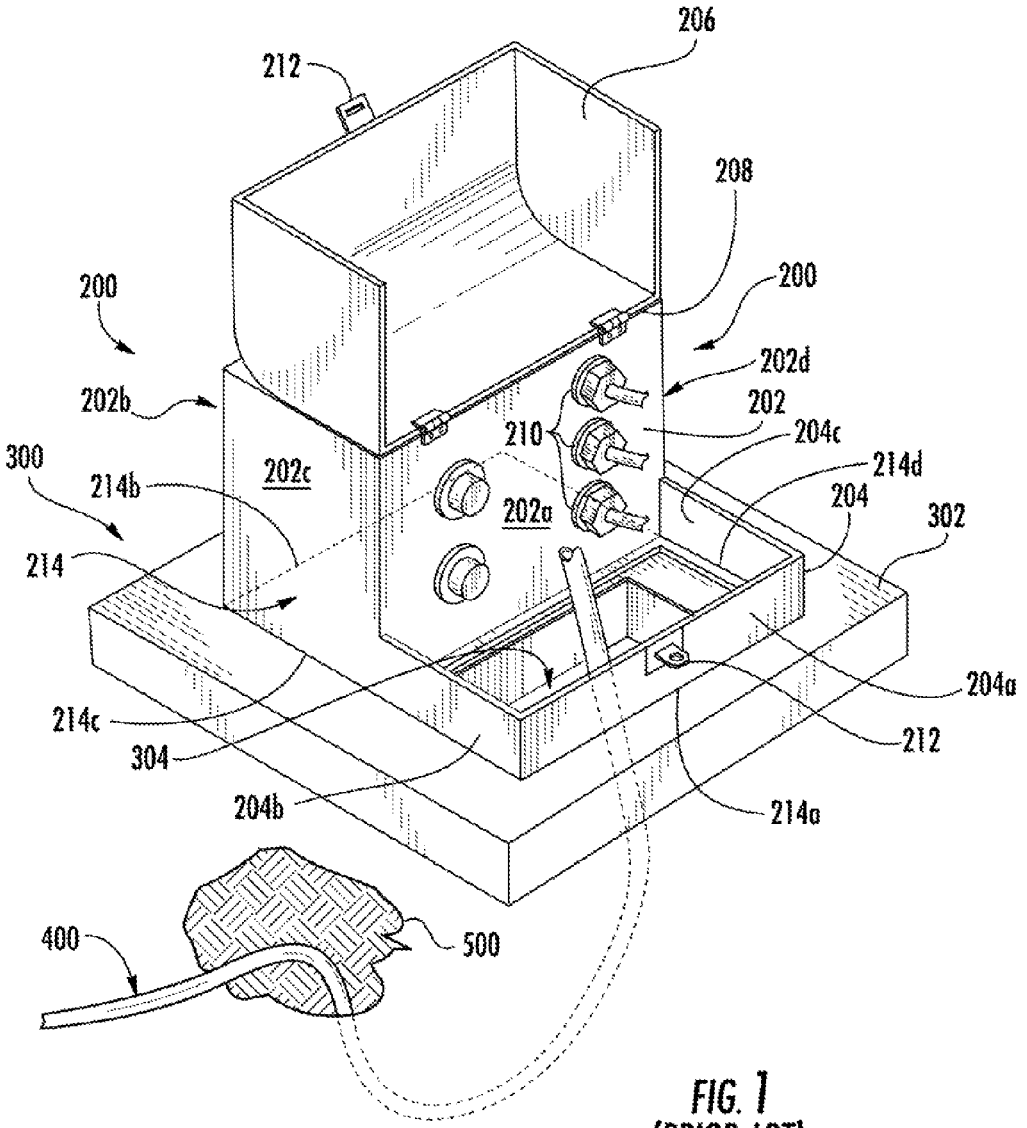
FIG. 1 (PRIOR ART)
FIG. 1 illustrates a typical installation of a temporary emergency cable to a pad-mounted-transformer in accordance with a method of the prior art.

It should be clearly understood at the outset like reference numerals are intended to identify the same structural elements, portions or surfaces consistently throughout the several drawings herein, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. It should also be noted that in order to promote clarity and ease of understanding by the reader, or merely for ease of illustration, the figures are not drawn to scale and the proportions of certain parts have been exaggerated from one figure to the next. As used in the following description, any reference to terms of orientation such as "horizontal", "vertical", "front", "rear", "left", "right", "up", "down", "inward" or "outward", "proximate", "distal", as well as adjectival and adverbial derivatives thereof (e.g., "horizontally", "vertically", "forwardly", "rearwardly", "leftward", "rightward", "upward", "downward", "inwardly" or "outwardly"), generally refer to the orientation of a surface or structure relative to its axis of elongation, or axis of rotation, as appropriate. One of ordinary skill in the art will also appreciate that a component may be designed as multiple components or that multiple components may be designed as a single component.

Before describing the construction and operation of the subject transformer access apparatus, it is helpful to understand not only the general layout of a conventional pad-mounted transformer, but also the existing method by which a temporary above ground cable is attached thereto. Accordingly, reference is first made to FIG. 1 depicting a pad-mounted-transformer 200 mounted on a pad 300, and further illustrating a typical installation of a temporary emergency cable 400 (also referred to herein as "ground strap 400") in accordance with a method of the prior art. Transformer pads are typically fabricated from concrete, fiberglass or plastic. Concrete pads can be poured in situ, or prefabricated off-site. Transformer pads typically have predominantly planar top surfaces 302 and include a pad opening 304 to provide access for connecting a transformer 200 to underground electrical cables below the pad.

Transformer 200 is comprised of a tank 202, which contains the core and coil assembly immersed in oil, from which a sill 204 (also known as a "skirt") extends frontally at its base, a hood 206 pivotally mounted to the front top edge 208 of tank 202 such that when closed hood 206 rests on sill 204 to prevent access to terminals 210 to which ground strap 400 is connected (connection not shown). A hood locking mechanism 212 secures the hood in a closed position to prevent inside access to the transformer by the public. Tank 202 has a front face 202*a*, rear face 202*b*, a left side face 202*c*, a right side face 202*d*, top face 202*e* and a bottom face (not shown). Sill 204 is generally U-shaped and includes a front section 204*a*, and a pair of side sections 204*b,c* extending perpendicularly from opposite ends of front section 204*a*. Sill 204, together with the rear face, top face, bottom face, left side face and a right side face of tank 202, comprise transformer cabinet 214. Transformer cabinet 214 in turn includes a bottom front edge 214*a*, a bottom rear edge 214*b*, a bottom left edge 214*c* and a bottom right edge 214*d*. Transformer 200 rests on the top surface 304 of pad 300 and may be fixedly mounted with bolts and other mounting hardware (not shown). Because of the substantial weight of most transformers, however, they are often left free-standing on the pad. When transformer 200 is properly situated on pad 300, the front face 202*a* of tank 202 together with sill 204 will together form a perimeter wall around pad opening 304. In addition to supporting hood 206, sill 204 further serves to exclude some insects, small animals and moisture from the inside of cabinet 214 generally, and supports a latch component of hood locking mechanism 212.

In the case of a power failure resulting from a faulted cable (not shown) connected to transformer 200, a substitute above ground emergency cable 400 is commonly connected to the transformer until the faulted cable can be repaired. The current practice is to create a temporary subterranean tunnel under the pad 300 and in communication with the pad opening 304 to permit entry of cable 400 into the transformer cabinet 214 other than through the space created by opening hood 206 which would prohibit its ability to be closed and locked and thus create a hazard to the public. The tunnel is created by digging a hole 500 next to the transformer pad 300, tunneling under the transformer pad, and then up to the pad opening so that the ground strap 400 may then be threaded through the tunnel and into cabinet 214 for connection to a terminal 210. As previously stated, this is an expensive task from a time and labor standpoint and often made more challenging by other factors such as weather and ground condition.

Figure 2:
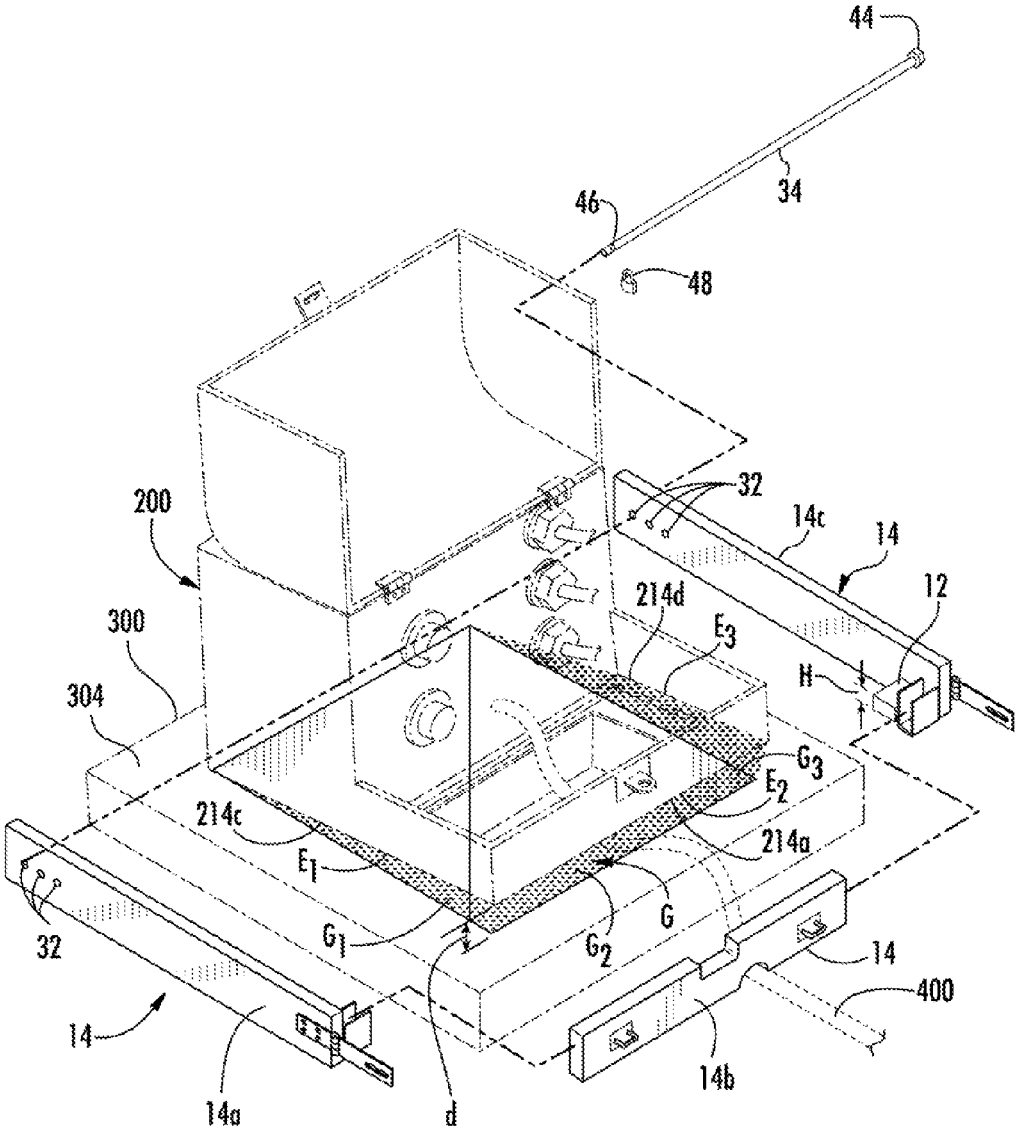
FIG. 2 is an exploded perspective view of a pad-mounted transformer access apparatus of the subject invention with a transformer, pad and emergency cable shown in phantom view.
Figure 3:
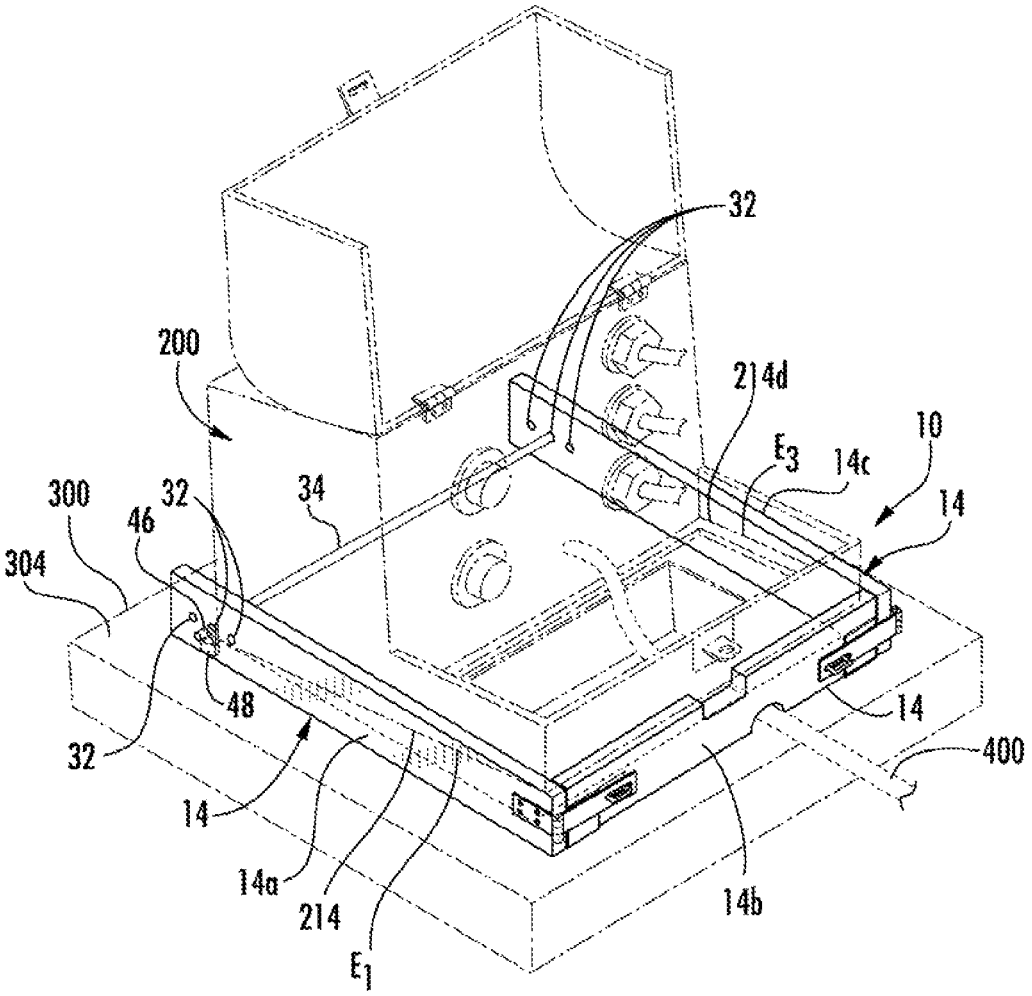
FIG. 3 is a perspective view of the pad-mounted transformer access apparatus of FIG. 1 shown mounted to a transformer cabinet.
Figure 4:
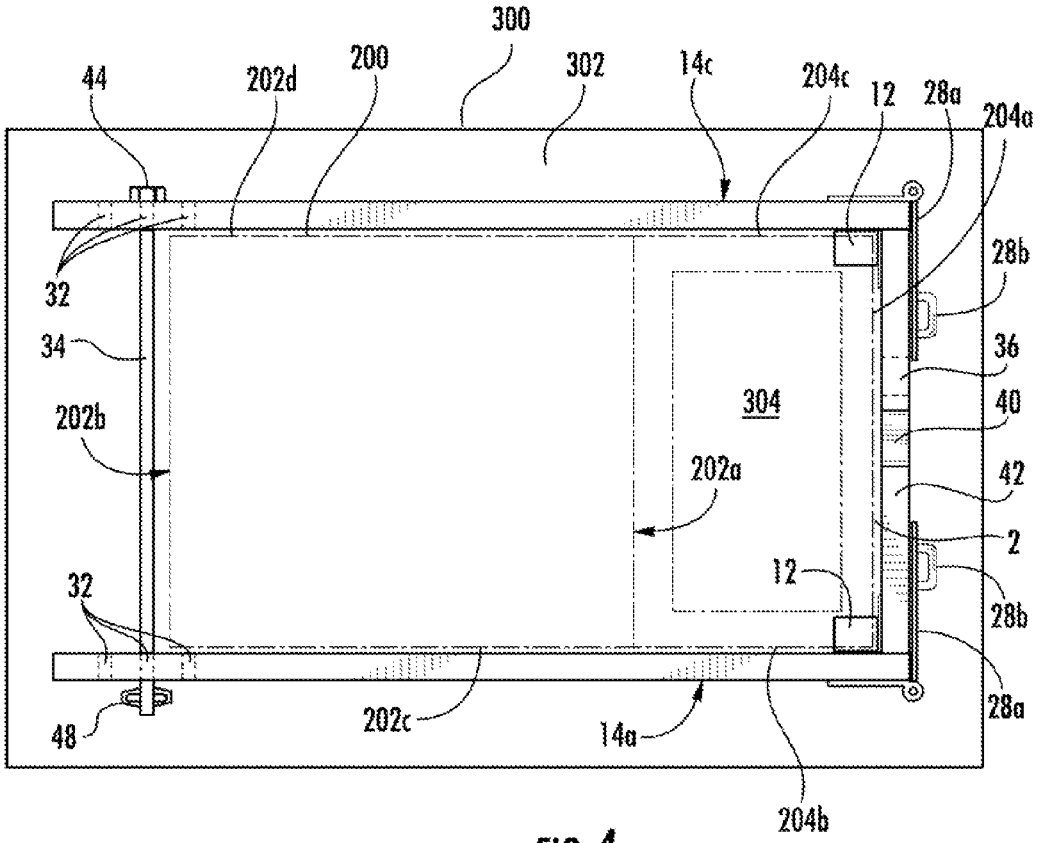
FIG. 4 is a plan view of the pad-mounted transformer access apparatus of FIG. 3.

In order to avoid the above described practice altogether, a method of the subject invention involves, very generally, supporting one end of a transformer cabinet a distance above the pad upon which it is mounted a distance sufficient to allow passage of the ground strap there between, covering the openings created between the cabinet and the pad with a barrier for security purposes, removably securing the barrier to the transformer, and then routing the ground strap through an opening in the barrier. With reference now being made to FIGS. 2-4, a first embodiment of a transformer access apparatus of the subject invention for providing secure temporary electric cable access to a pad-mounted transformer is identified by reference numeral 10 and includes at least one riser 12 for supporting one end (or side) of a pad-mounted transformer 200 above a pad 300 upon which the transformer is mounted in order to create a gap G (also referred to herein as an opening and represented by shading in FIG. 2) between the pad and the cabinet. Any means may be employed to elevate transformer 200 off of pad 300 for subsequent placement on the at least one riser 12. In practical terms, however, this may be accomplished in most instances manually by the utility repair personnel, rather than using heaving equipment, by employing any variety of levers 600 such as that illustrated in FIG. 10.

Each at least one riser 12 has a height H (relative to the pad upon which it rests) sufficient to elevate a side or end of the transformer 200 above the top surface 304 of pad 300 a distance d sufficient to allow passage of cable 400 through gap G. The height of the risers, therefore, is greater than the diameter of the cable. In some embodiments, risers 12 are relatively block shaped possessing relatively flat and coplanar top and bottom surfaces although risers may also be wedge shaped. In the embodiment shown, two risers 12 are shown; one under each front corner of sill 204, to provide greater stability of transformer 200 while elevated than a single riser can provide.

Once a side or end of transformer 200 has been elevated upon the at least one riser 12, the resulting gap G is created and presents an entry point not only for ground strap 400 as described below, but for small animals, reptiles, amphibians, insects, debris and human-introduced objects like sticks, rods and the like. When only one end of transformer 200 is elevated onto risers such that one of the transformers four sides remains in contact with the pad, as opposed to elevating all of four sides which is unnecessary, gap G may be viewed as consisting of three portions, namely a first gap portion $G_1$ defined by the area between pad top surface 304 and a first elevated edge $E_1$ of transformer 200 (in the example illustrated corresponding to bottom left edge 214*c* of transformer cabinet 214), a second gap portion $G_2$ defined by the area between pad top surface 304 and a second elevated edge $E_2$ of transformer 200 (in the example illustrated corresponding to bottom front edge 214*a* of transformer cabinet 214), and a third gap portion $G_2$ defined by the area between pad top surface 304 and a third elevated edge $E_3$ of transformer 200 (in the example illustrated corresponding to bottom right edge 214*d* of transformer cabinet 214).

In order to prevent unwanted or unauthorized access into cabinet 214 through gap G, the subject transformer access apparatus 10 further includes a barrier 14 to cover at least gap G and prevent access there through, except as described below, and is constructed of materials resistant to bending or otherwise being forced out of shape such as metal, metal alloys, wood, fiberglass, various plastics, or composites of any of the foregoing and all being of suitable thickness and hardness to serve as a barrier to foreign objects. In preferred embodiments, barrier 14 is comprised of three elongated members, preferably rectangular in cross section, namely first lateral barrier 14*a*, transverse barrier 14*b*, and second lateral barrier 14*c* arranged in series into a U-shape and each sized to cover at least gaps $G_1$, $G_2$ and $G_3$, respectively.

Figure 6:
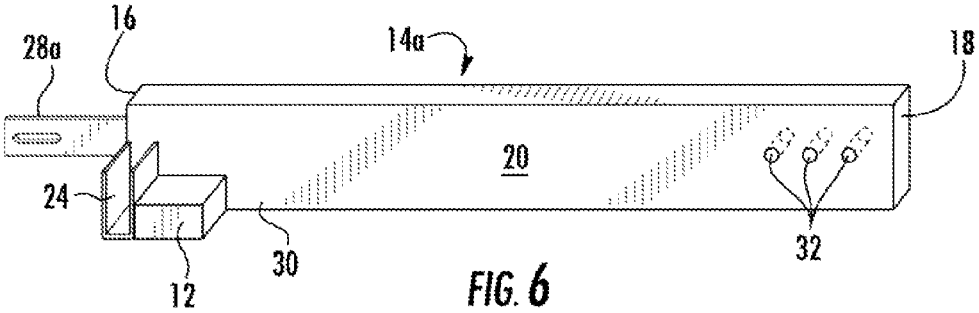
FIG. 6 is a back perspective view of a first lateral barrier component of the subject apparatus.
Figure 7:
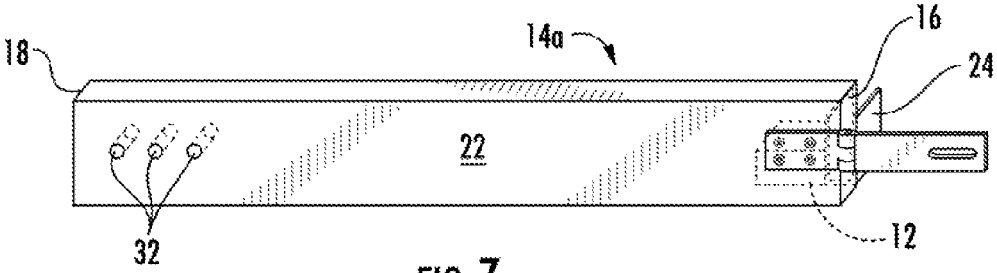
FIG. 7 is a front perspective view of the first lateral barrier component of FIG. 6.
Figure 8:
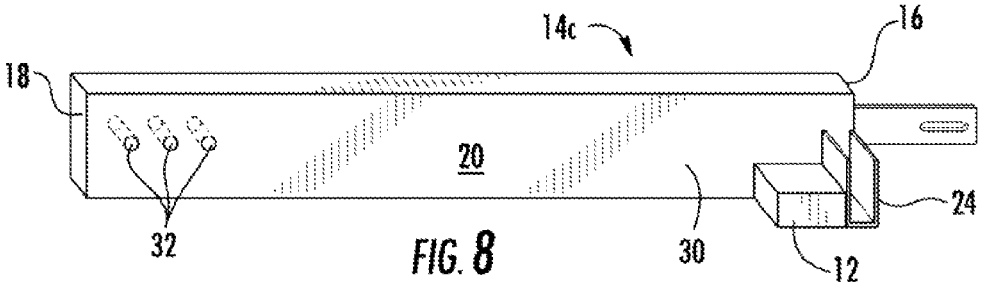
FIG. 8 is a back perspective view of a second lateral barrier component of the subject apparatus.
Figure 9:
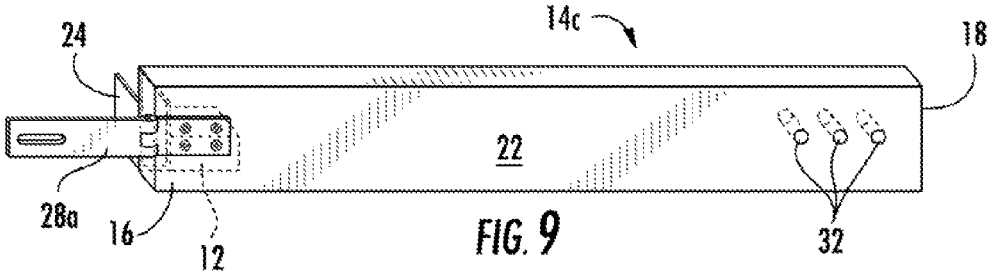
FIG. 9 is a front perspective view of the second lateral barrier component of FIG. 8.

First lateral barrier 14*a* (FIGS. 6 and 7) and second lateral barrier 14*c* (FIGS. 8 and 9) each include a proximal end 16, a distal end 18, an inside face 20, and an outside face 22. A mounting bracket 24 is fixedly attached to the proximal end 16 of each lateral barrier 14*a,c* normal to its inside face 20 for receiving therein in mating engagement ends 26 of transverse barrier 14*b* as best observed in FIG. 4. As best observed upon reference to FIG. 5, the union of each lateral barrier 14*a,c* with transverse barrier 14*b* may be secured to one another with corner laches 28 comprising a hasp 28*a* mounted to the outer face 22 of proximal end 16 of each lateral barrier 14*a,c* and corresponding loop 28*b* mounted in proximity to each end 26 of transverse barrier 14*b*. Laches 28 are secured with a lock (not shown) to prevent separation of the barrier components. As should readily be appreciated, although brackets 24 are described and illustrated herein as mounted to lateral barriers 14*a,c*, they could alternatively be mounted normal to each end 26 of transverse barrier 14*b* for receiving the proximal ends 16 of lateral barriers 14*a,c*. Those skilled in the art will recognize other methods of removably or permanently attaching the three barrier components together. In preferred embodiments, each lateral barrier 14*a,c* further includes at its base 30, a riser 12 mounted distally and in abutting engagement with bracket 24 and normal to inside face 20 for receiving a portion of transformer 200 thereon as previously described. Each lateral barrier 14*a,c* further includes at its distal end 18 a plurality of incrementally spaced apertures 32 disposed transversely there through from inside face 20 to outside face 22 for receiving security bar 34 as described more fully below. In certain embodiments, lateral barriers 14*a,c*, together with their respective mounting brackets 24, risers 12, laches 28 and apertures 32, are mirror images of one another.

Figure 5:
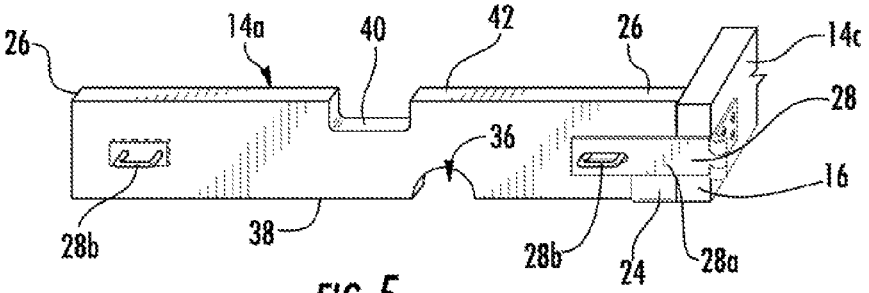
FIG. 5 is a frontal view of a transverse barrier component of the subject apparatus.

A cable access portal 36 is provided in one of either the lateral barriers 14*a,c* or transverse barrier 14*b* (as shown) for axial receipt of ground strap 400 there through. In certain embodiments and as shown in FIG. 5, cable access portal 36 is in communication with a bottom edge 38 of the barrier 14 to permit ground strap 400 to rest on pad 200 (FIG. 3) when passing through the portal. In other embodiments, cable access portal 36 may be entirely circumscribed by the barrier component through which it is disposed. As should be readily appreciated, cable access portal 36 is sized to be only as large as necessary to permit axial reception of a ground strap in order to maintain the protective function of the barrier 14 through which it is disposed.

With continued reference to FIGS. 2-5, certain embodiments of the subject transformer access apparatus 10 include a notch 40 in top edge 42 of barrier 14. Notch 40 is sized and positioned to permit abutting engagement of barrier 14 around the base of the three elevated sidewalls of transformer cabinet 214 without interference from locking mechanism 212. In the embodiment illustrated, notch 40 is medially situated along top edge 42 of transverse barrier 14*b* to accommodate locking mechanism 212 when transverse barrier 14*b* is positioned against front section 204*a* of sill 204.

Method of Use

Figure 10:
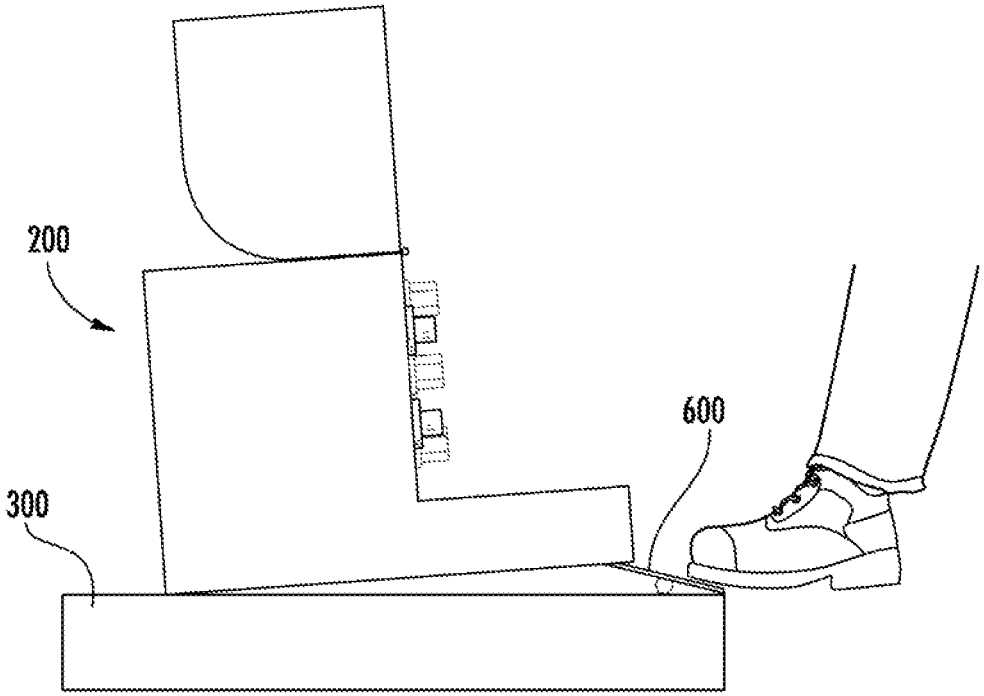
FIG. 10 illustrates the use of a simple lever to elevate an end of a pad-mounted transformer in accordance with the teachings of the subject invention.

Having described various embodiments of the subject transformer access apparatus in detail, it method of installation and use shall now be described. Referring first to FIG. 10, providing temporary and secure ground strap access to a transformer terminal in accordance with a method of the subject invention first requires elevation of at least one end of the transformer 200 above the surface 302 of pad 300 high enough so that at least one riser 12 may be inserted under the elevated end. As previously mentioned, a lever 600 may be used for this purpose or any other suitable method known in the art such as the use of forklifts or other heavy equipment capable of lifting transformer 200. The elevated end is then lowered to rest on the at least one riser 12 creating gaps $G_1$,$G_2$,$G_3$ between the surface 302 of pad 300 and the first, second and third elevated edges $E_1$,$E_2$,$E_3$, respectively, of transformer 200.

Referring to FIGS. 2 and 3, two risers 12 are employed; one at each end of the elevated end of the transformer 200. In certain embodiments, risers 12 are connected to first and second lateral barriers 14*a,c*. Accordingly, the installer of the apparatus 10 places first and second lateral barriers 14*a,c* in abutting or near abutting relationship with the transformer cabinet 214 so as to cover, respectively, gaps $G_1$,$G_2$, in no particular order, and such that each riser 12 is positioned for supportive engagement with the elevated end of transformer 200 (in this case the end comprising front section 204*a* of sill 204). Thusly installed, the distal ends 18 and at least one aperture 32 of each lateral barrier 14*a,c* extend past the opposite end of transformer 200, namely the end that remains in contact with pad 300 (in this case the end comprising rear face 202*b* of tank 202), and the proximal ends 16 and brackets 24 of each lateral barrier 14*a,c* extend past the elevated end of transformer 200. Transverse barrier 14*b* is then disposed between first and second lateral barriers 14*a,c* such that each of its ends 26 are mounted within brackets 24. Thusly installed, transverse barrier 14*b* is situated in abutting or near abutting relationship with the transformer cabinet 214 so as to cover gap $G_2$. Together, first and second lateral barriers 14*a,c* and transverse barrier 14*b*, therefore, form one contiguous barrier to prevent outside access to gap G.

In order to secure barrier 14 about transformer cabinet 214 and prevent its removal, a barrier lock is employed. In one embodiment, barrier lock includes a security bar 34 which is inserted through a pair of opposing apertures 32 of each lateral barrier 14*a,c* until prevented from further advancement by flange 44 located at one end of the bar. The closest pair of apertures 32 to transformer 200 are preferred, provided they are not obscured or partially obscured by the transformer cabinet 214. Security bar is prevented from removal by inserting a lock 48 through transverse slot 46 at the opposite end of the bar. As should be readily appreciated, security bar 34 prevents horizontal displacement of barrier 14 while the weight of transformer 200 on top of risers 12 prevents its vertical displacement. Once properly secured, an end of ground strap 400 may be inserted axially through cable access portal 36 for attachment to a transformer terminal and lid 206 secured in a closed position via locking mechanism 212.

Accordingly, a method of providing secure ground strap access to a transformer terminal comprises the steps of: 1) supporting at least one end of a pad-mounted transformer 200 on at least one riser 12 disposed between the transformer 200 and the pad 300, thereby creating a gap G between the transformer and the pad, the gap G having a height greater than the diameter of the ground strap 400; 2) covering gap G with a barrier 14 sized to cover at least gap G, the barrier 14 having an access portal 36 sized to permit axial passage of ground strap 400 there through; and 3) securing barrier 14 in place about the base of transformer 200 with a barrier lock.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed as being new, useful and desired to be protected by Letters Patent of the United States is as follows:

1. An apparatus for providing temporary secure electric cable access to a terminal of a transformer mounted on a pad, the apparatus comprising:

a. at least one riser to support an end of the pad-mounted transformer with a distance above the pad thereby creating a gap between the pad and the transformer, said distance being sufficient to allow axial passage of the cable through the gap;

b. a barrier having a shape to permit abutting engagement of said barrier with the transformer and sized to cover the gap;

c. a cable access portal disposed through said barrier; said cable access portal being sized to permit axial passage of the cable; and d. a barrier lock removably mounted to said barrier for removably securing said barrier to the transformer to prevent displacement of said barrier from the transformer.

2. The apparatus for providing temporary secure electric cable access to a terminal of a transformer mounted on a pad of claim 1, wherein said at least one riser is fixedly attached to said barrier.

3. The apparatus for providing temporary secure electric cable access to a terminal of a transformer mounted on a pad of claim 1, wherein said barrier comprises a first lateral barrier, a transverse barrier and a second lateral barrier.

4. The apparatus for providing temporary secure electric cable access to a terminal of a transformer mounted on a pad of claim 3, wherein said at least one riser is fixedly attached to said barrier.

5. The apparatus for providing temporary secure electric cable access to a terminal of a transformer mounted on a pad of claim 4, wherein said first lateral barrier, said transverse barrier and said second lateral barrier each comprise an elongated member rectangular in cross section and constructed of a material resistant to bending or otherwise being forced out of shape.

6. The apparatus for providing temporary secure electric cable access to a terminal of a transformer mounted on a pad of claim 3, wherein said first lateral barrier, said transverse barrier and said second lateral barrier are removably connected in series to form a U-shape for abutting engagement with three sides of the transformer.

7. The apparatus for providing temporary secure electric cable access to a terminal of a transformer mounted on a pad of claim 6, wherein said at least one riser is fixedly attached to said barrier.

8. The apparatus for providing temporary secure electric cable access to a terminal of a transformer mounted on a pad of claim 7, wherein said first lateral barrier, said transverse barrier and said second lateral barrier each comprise an elongated member rectangular in cross section and constructed of a material resistant to bending or otherwise being forced out of shape.

9. The apparatus for providing temporary secure electric cable access to a terminal of a transformer mounted on a pad of claim 3, wherein said first lateral barrier, said transverse barrier and said second lateral barrier each comprise an elongated member rectangular in cross section and constructed of a material resistant to bending or otherwise being forced out of shape.

10. The apparatus for providing temporary secure electric cable access to a terminal of a transformer mounted on a pad of claim 6, wherein said first lateral barrier, said transverse barrier and said second lateral barrier each comprise an elongated member rectangular in cross section and constructed of a material resistant to bending or otherwise being forced out of shape.

11. A method of providing secure ground strap access to a terminal of a transformer mounted on a pad comprises the steps of: 1) supporting at least one end of the transformer on at least one riser having a height greater than the diameter of a ground strap and being disposed between said transformer and the top surface of said pad thereby creating a gap between said transformer and said top surface of said pad; 2) covering said gap with a barrier in abutting engagement with said transformer, said barrier having an access portal sized to permit axial passage of said ground strap there through; and 3) securing said barrier to said transformer with a barrier lock.

12. The method of claim 11, wherein said at least one riser fixedly attached to said barrier.

13. The method of claim 11, wherein said barrier comprises a first lateral barrier, a transverse barrier and a second lateral barrier.

14. The method of claim 13, wherein said at least one riser is fixedly attached to said barrier.

15. The method of claim 14, wherein said first lateral barrier, said transverse barrier and said second lateral barrier each comprise an elongated member rectangular in cross section and constructed of a material resistant to bending or otherwise being forced out of shape.

16. The method of claim 13, wherein said first lateral barrier, said transverse barrier and said second lateral barrier are removably connected in series to form a U-shape for abutting engagement with three sides of the transformer.

17. The method of claim 16, wherein said at least one riser is fixedly attached to said barrier.

18. The method of claim 17, wherein said first lateral barrier, said transverse barrier and said second lateral barrier each comprise an elongated member rectangular in cross section and constructed of a material resistant to bending or otherwise being forced out of shape.

19. The method of claim 16, wherein said first lateral barrier, said transverse barrier and said second lateral barrier each comprise an elongated member rectangular in cross section and constructed of a material resistant to bending or otherwise being forced out of shape.

20. The method of claim 13, wherein said first lateral barrier, said transverse barrier and said second lateral barrier each comprise an elongated member rectangular in cross section and constructed of a material resistant to bending or otherwise being forced out of shape.

* * * * *